US005909229A

United States Patent [19]

Moriguchi et al.

[11] Patent Number: 5,909,229

[45] Date of Patent: Jun. 1, 1999

[54] RECORDING APPARATUS IN WHICH PRESSURE INTERFERENCE BETWEEN CLOSELY-SPACED INK JETS IS REDUCED

[75] Inventors: Haruhiko Moriguchi; Nobuyuki Watanabe; Hisashi Fukushima, all of Yokohama, Japan

[73] Assignee: Canon Kabushiki Kaisha, Tokyo, Japan

[21] Appl. No.: 08/220,574

[22] Filed: Mar. 31, 1994

Related U.S. Application Data

[63] Continuation of application No. 07/646,256, Jan. 28, 1991, abandoned.

[30] Foreign Application Priority Data

Feb. 2, 1990 [JP] Japan ..... 2-22205

[51] Int. Cl.[6] ..... B41J 2/05

[52] U.S. Cl. ..... 347/13; 347/14; 347/43

[58] Field of Search ..... 346/1.1, 140 R; 358/298, 459; 347/14, 15, 43, 12, 13, 180–182

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,395,146 | 7/1983 | Arai | 347/182 X |
| 4,459,600 | 7/1984 | Sato et al. | 347/56 X |
| 4,463,359 | 7/1984 | Ayata et al. | 347/13 X |
| 4,514,768 | 4/1985 | Ishizawa | 358/298 X |
| 4,558,333 | 12/1985 | Sugitani et al. | 347/65 |
| 4,596,995 | 6/1986 | Yamakawa et al. | 347/13 X |
| 4,639,747 | 1/1987 | Sakurada et al. | 347/12 |
| 4,675,700 | 6/1987 | Nagira et al. | 347/182 |
| 4,723,129 | 2/1988 | Endo et al. | 347/56 |
| 4,737,860 | 4/1988 | Ono et al. | 358/298 |
| 4,740,796 | 4/1988 | Endo et al. | 347/56 |
| 4,748,453 | 5/1988 | Lin et al. | 347/43 X |
| 4,751,520 | 6/1988 | Mizoguchi | 347/188 |
| 4,829,323 | 5/1989 | Suzuki et al. | 347/43 X |
| 4,831,392 | 5/1989 | Dei | 358/298 X |
| 4,875,056 | 10/1989 | Ono | 347/180 |
| 4,876,612 | 10/1989 | Honma et al. | 358/474 |
| 5,252,992 | 10/1993 | Fukushima et al. | 347/43 |

FOREIGN PATENT DOCUMENTS

| | | | |
|---|---|---|---|
| 58-136451 | 8/1983 | Japan | B41J 3/04 |
| 59-123670 | 7/1984 | Japan . | |
| 59-138461 | 8/1984 | Japan . | |

*Primary Examiner*—Alrick Bobb

*Attorney, Agent, or Firm*—Fitzpatrick, Cella, Harper & Scinto

[57] ABSTRACT

There is provided an ink jet recording apparatus such as a bubble jet recording apparatus, comprising: an ink jet recording head in which a plurality of groups each consisting of a plurality of emission ports which are simultaneously driven are continuously arranged; a detector to detect an edge of an input image; and a second driver for sequentially changing the driving order of the groups or sequentially driving the groups which are not neighboring in accordance with the result of the edge detection by the detector. The recording head causes a volume change by an action of a heat energy which is generated from a recording element such as an electrothermal converting element or a thermal resistor element by supplying a pulse-shaped current thereto, thereby emitting an ink droplet from each opening. The recording apparatus uses a plurality of recording elements which are divided into a plurality of blocks and are driven at different timings for every block.

50 Claims, 11 Drawing Sheets

RECORDING APPARATUS IN WHICH PRESSURE INTERFERENCE BETWEEN CLOSELY-SPACED INK JETS IS REDUCED

This application is a continuation of application Ser. No. 07/646,256 filed Jan. 28, 1991, now abandoned.

BACKGROUND OF THE INVENTION

1. Field of the Invention

The present invention relates to an ink jet recording apparatus and, more particularly, to an ink jet recording apparatus in which a plurality of recording elements are divided into blocks and are driven at different timings every block.

2. Related Background Art

The ink jet recording method is a recording method whereby emission liquid droplets of a recording liquid (hereinafter, referred to as an ink) are formed by various methods and are adhered onto a recording medium such as a recording paper or the like, thereby recording.

Among recording apparatuses using the above recording method, an ink jet recording apparatus of the type which uses heat as an energy to form emission liquid droplets can be mentioned as an apparatus suitable to construct a recording head by arranging a number of emission ports at a high density.

In the ink jet recording apparatus using the heat as an energy to emit the liquid droplets, generally, by heating the ink, a displacement accompanied with a sudden increase in volume is given into the ink and ink droplets are emitted from the emission ports in association with such a displacement. For this purpose, the apparatus has a recording head comprising: an electrothermal converting element for generating heat and heating the ink; an ink liquid path which is communicated with the emission port and allows the heat generated by the electrothermal converting element to act on the ink; and the like. In the case of a recording head having a plurality of emission ports, a plurality of electrothermal converting elements and the like are also provided in correspondence to the emission ports.

The conventional ink jet recording head having such electrothermal converting elements, particularly, the ink jet recording head in which a plurality of electrothermal converting elements $R_1$ to $R_{mn}$ are arranged in accordance with a plurality of emission ports corresponding to a recording width of one line as shown in FIG. 9, uses a structure such that the electrothermal converting elements are divided into a plurality of blocks (m blocks in FIG. 9) and the electrothermal converting elements are driven every block.

For example, in the case of driving the electrothermal converting elements at timings as shown in FIG. 10 in the circuit as shown in FIG. 9, a group of electrothermal converting elements corresponding to each of driving ICs comprising flip-flops $\mathbf{35}_1$ to $\mathbf{35}_m$, AND gates $\mathbf{36}_1$ to $\mathbf{36}_m$ and $\mathbf{37}_1$ to $\mathbf{37}_m$, latch circuits $\mathbf{38}_1$ to $\mathbf{38}_m$, and shift registers $\mathbf{39}_1$ to $\mathbf{39}_m$ are sequentially driven as one block, respectively.

Electric power consumption to drive the ink jet recording head by the above method is remarkably smaller than that of an apparatus which does not drive the electrothermal converting elements on a block unit basis, so that the above block driving method is used hitherto.

However, the above block driving method has the following problems because the electrothermal converting elements are driven every block.

A size of a common liquid chamber is limited depending on the structure of the head. To realize high-speed recording, it is a fundamental manner to reduce the driving time of each driving block as short as possible and to also reduce the driving time difference among the blocks as small as possible and to reduce the time which is required to form an image of one line. It has been found out from experiments that if an image is formed under the above conditions, a variation in concentration corresponding to the driving block occurs. Such a variation extremely deteriorates the image quality and is not practical.

SUMMARY OF THE INVENTION

In consideration of the above points, it is an object of the invention to solve the above problems and to provide an ink jet recording apparatus of high speed and high image quality.

Another object of the invention is to provide an ink jet recording apparatus having an ink jet recording head in which a plurality of driving blocks which are constructed by a plurality of emission ports which are continuously arranged and are simultaneously driven are arranged, wherein the apparatus comprises: detecting means for detecting an edge of an input image; and first driving means for sequentially changing a driving order of the driving blocks in accordance with the result of the detection by the detecting means.

Still another object of the invention is to provide an ink jet recording apparatus having an ink jet recording head in which a plurality of driving blocks, which are constructed by a plurality of emission ports that are continuously arranged and are simultaneously driven are arranged, wherein the apparatus has second driving means for sequentially driving the driving blocks which are not in contact with each other.

A further object of the invention is to provide a recording apparatus in which an edge portion of an input image is detected by detecting means and the driving order of driving blocks can be changed in accordance with the result of the detection by the detecting means.

DETAILED DESCRIPTION OF THE PREFERRED EMBODIMENTS

Embodiments of the invention will be described in detail hereinbelow with reference to the drawings.

Figure 1:
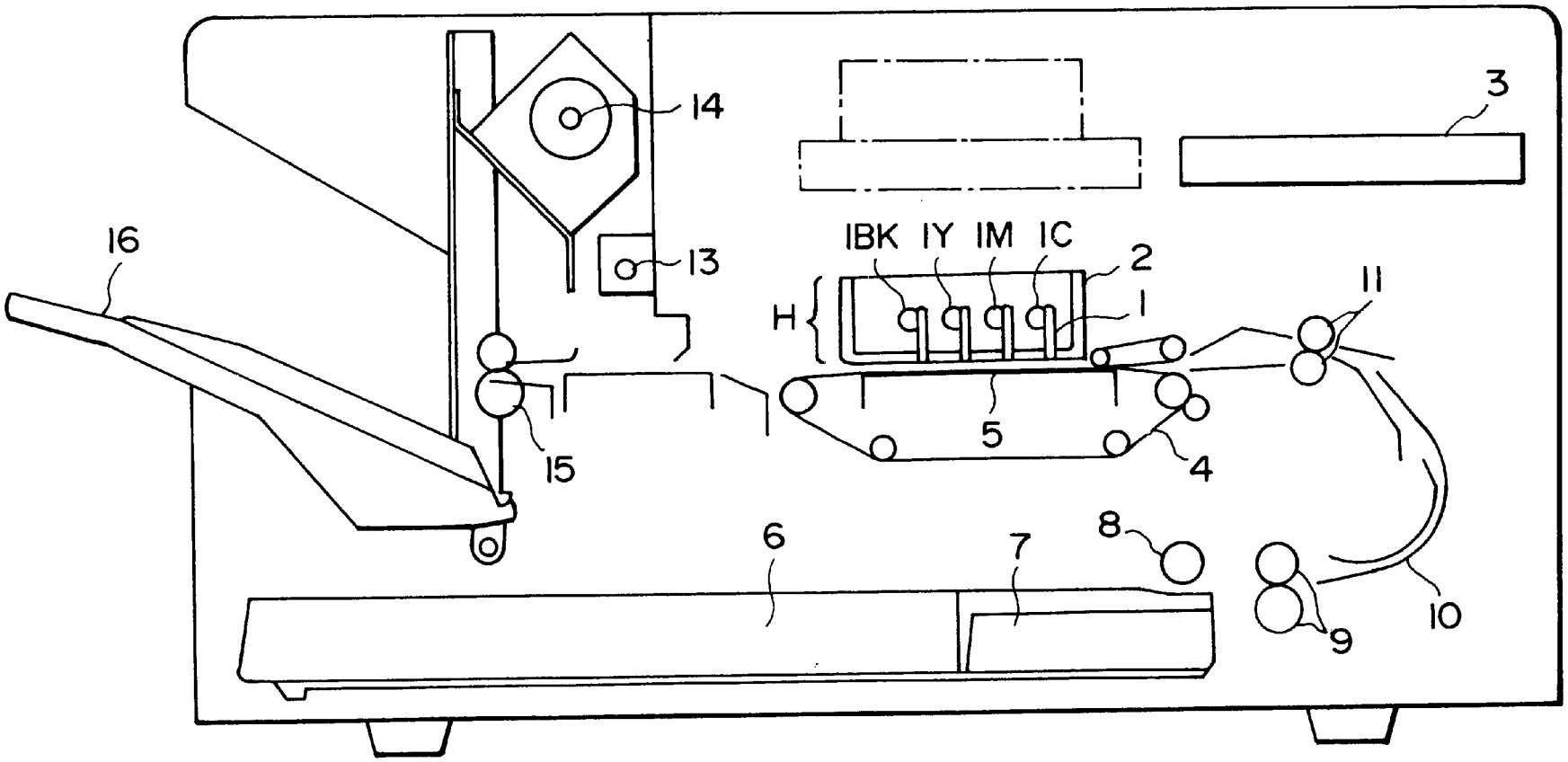
FIG. 1 is a diagram showing a structure of the first embodiment of the invention.

FIG. 1 is a schematic side elevational view showing an ink jet recording apparatus according to the first embodiment.

In FIG. 1, H denotes a head section; 1BK, 1Y, 1M, and 1C denote recording heads of the bubble jet type corresponding to the ink colors of black, yellow, magenta, and cyan, respectively. A heat generating resistor is used as an emission energy generating element provided in each recording head. When a current is supplied, an air bubble is produced in the ink and an ink droplet is emitted from an emission port by using the air bubble as a pressure source. Those recording heads are fixed to a block 2. 4736 emission ports are arranged in each of the recording heads at a density of 400 dpi.

Reference numeral 3 denotes a capping unit. The block 2 is lifted up to a position shown by alternate long and short dash lines in the diagram in the non-recording mode such as a standby mode or the like, thereby allowing the unit 3 to face and cap the block 2. In the circulating recovery mode, the capping unit 3 is used as a receiving pan to collect the drained ink which had been supplied from a recovery pump and an ink supply system (not shown) and was drained out of the emission port. The drained ink is led into a drain ink tank (not shown).

Reference numeral 4 denotes an endless charging adsorbing belt which is arranged so as to respectively face the recording heads 1BK, 1Y, 1M, and 1C with a predetermined interval and is used to convey a recording sheet and 5 indicates a back platen which is arranged so as to face the recording heads through the belt 4.

Reference numeral 6 denotes a paper feed cassette in which recording sheets 7 such as ordinary papers or the like are enclosed and which is detachably set into the apparatus main body; 8 indicates a pickup roller for picking up only the top one of the recording sheets 7 and feeding the sheet into the apparatus; 9 a conveying roller to convey the recording sheet 7 which was fed by the pickup roller 8 to a conveying path 10; and 11 a conveying roller arranged on the exit side of the conveying path 10.

Reference numerals 13 and 14 denote a heater and a fan to dry and fix the ink droplets adhered onto the recording sheet 7 by the recording by using a hot wind. Reference numeral 15 denotes a discharge roller to discharge the recording sheet 7 after completion of the fixing process to the outside of the apparatus and 16 indicates a tray to sequentially stock the discharged recording sheets 7.

The operation of the embodiment by the above construction will now be described.

The recording operation will be first described. When the operation to start the recording (operation panel 1020 shown in FIG. 11) is executed, the recording sheet 7 of the designated size is fed out of the paper feed cassette 6 by the pickup roller 8. The supplied recording sheet 7 is rotated by the conveying rollers 9 and 11 in a precharged state and is put onto the belt 4 having a flat shape due to the back platen 5. In association with that the front edge portion of the recording sheet 7 arrives at positions below the recording heads 1C, 1M, 1Y, and 1BK, respectively, the energy generating elements of the recording heads are driven through drivers, which will be explained hereinlater, in accordance with image data. By driving the energy generating elements, ink droplets according to the image data are emitted from the emission ports onto the surface of the recording sheet 7 and the recording is executed.

If a hygroscopicity of the recording sheet 7 is bad, the liquid droplets adhered onto the surface are not dried but are rubbed and a print smudging occurs. To prevent such a state, the ink droplets are forcibly dried and fixed by the heater 13 and fan 14. The recording sheet 7 on which the ink droplets were fixed is discharged to the tray 16 by the discharge roller 15.

As mentioned above, a color image is formed by supplying recording signals according to the recording heads corresponding to the inks of cyan, magenta, yellow, and black, respectively.

An emitting principle of the ink jet recording head which is used in the apparatus of the embodiment will now be described.

The recording head which is applied to the ink jet recording apparatus generally comprises: a fine emission port; a liquid path; an energy acting portion which is provided in a part of the liquid path; and an energy generating means for generating a liquid droplet forming energy which acts on the liquid existing in the acting portion.

As a method of generating such an energy, there are the following methods: a recording method using an electromechanical converting element such as a piezoelectric transducer or the like; a recording method using energy generating means which is constructed in a manner such that an electromagnetic wave such as a laser beam or the like is irradiated and absorbed into a liquid existing there to thereby generate heat and a liquid droplet is emitted due to the operation by the heat generation; a recording method using energy generating means for heating a liquid by an electrothermal converting element and emitting the liquid; or the like.

The recording head which is used in the ink jet recording method whereby liquid is emitted by thermal energy is advantageous among those recording methods because the emission ports can be arranged at a high density to form liquid droplets for flying by emitting the liquid droplets for recording, so that the recording at a high resolution can be executed. On the other hand, the recording head using an electrothermal converting element as energy generating means can be easily formed into a compact size as a whole recording head and can sufficiently use the advantages of the integrated circuit (IC) technique and microworking technique in which the progress of the techniques and the improvement of the reliability in the recent semiconductor field are remarkable. A long-shaped or plane-shaped (two-dimensional) recording head can be easily realized and the like. Therefore, it is possible to provide an ink jet recording head in which a multi-nozzle structure and a high-density installation structure can be easily realized, high mass-productivity is attainable, and manufacturing costs are also low.

The ink jet recording head in which the electrothermal converting element is used as energy generating means and which was manufactured by a semiconductor manufacturing process generally has a structure such that a liquid path corresponding to each emission port is provided, an electrothermal converting element is provided as means for generating heat energy in the liquid filled in each liquid path and emitting the liquid from the corresponding emission port, thereby forming a liquid droplet for flying, and the liquid is supplied to each liquid path from a common liquid chamber communicated with each liquid path.

Figure 11:
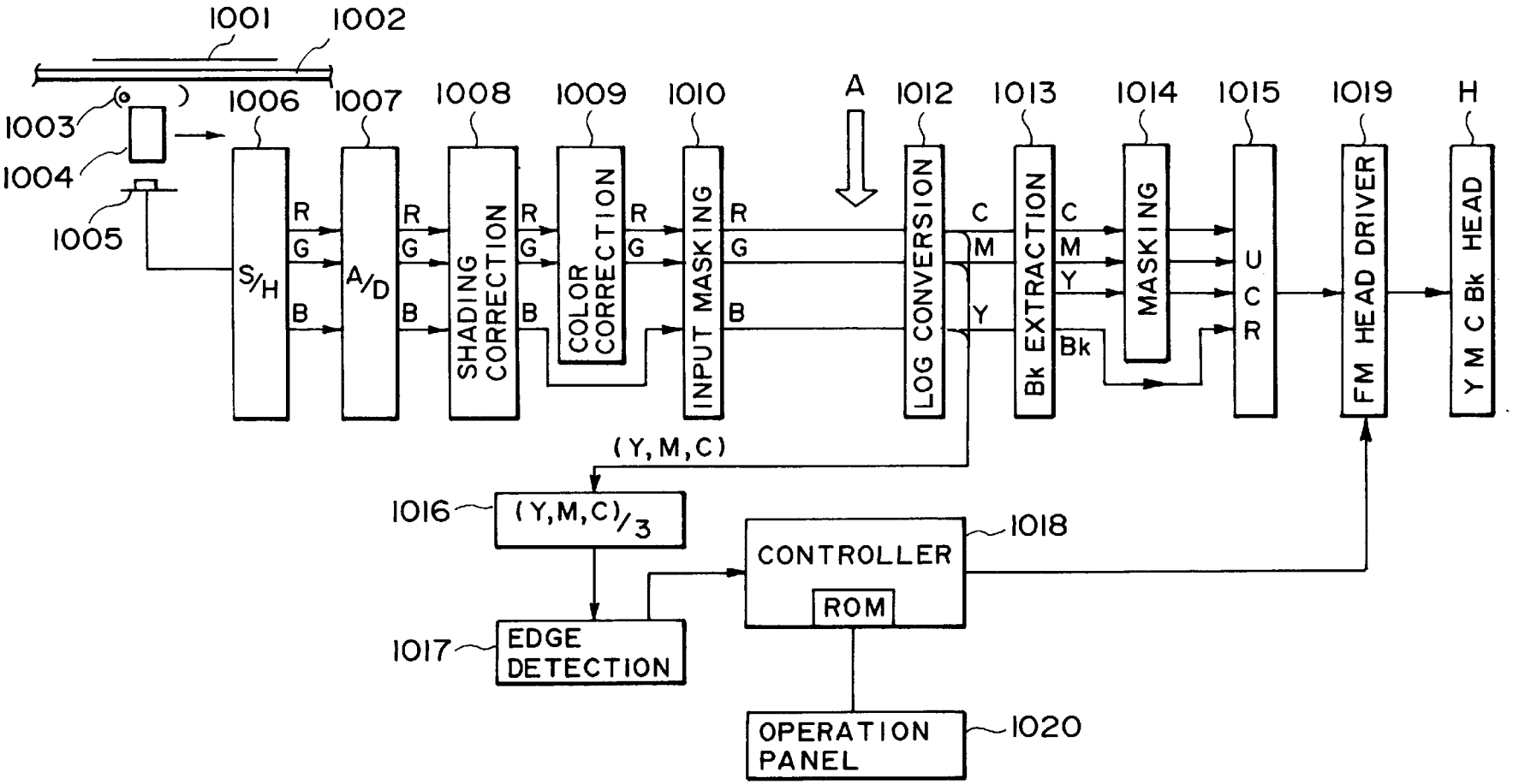
FIG. 11 is a block diagram showing a construction of the ink jet recording apparatus shown in FIG. 1.

FIG. 11 is an explanatory diagram of a constructional block of the ink jet recording apparatus shown in FIG. 1. Although a scanner section (1001 to 1005) is provided in FIG. 11, it is sufficient to construct the printer shown in FIG. 1 in a manner such that RGB data or YMC data which is generated from a host such as a computer or the like is input from A in FIG. 11 through an interface. On the other hand, it is also possible to construct in a manner such that the operating mode can be switched to a local mode by the operation panel 1020 and the input which is input from the input interface (A) from a scanner can be properly switched.

A recording apparatus with a scanner will now be described in detail hereinbelow with reference to FIG. 11.

An original base plate 1002 provided on an original base glass 1001 is illuminated by a halogen lamp 1003 to illuminate an original. An image of the original is formed onto a CCD line sensor 1005 by a rod lens array (for instance, a Cellfoc lens; tradename) 1004. The CCD line sensor 1005 is constructed by dot-sequentially coating color separation filters of R, G, and B and generates color separation signals of the original at a resolution of 400 dpi. The components 1003 to 1005 are scanned in the direction of an arrow and sequentially read out the original image with every line and generate an image signal. A sample and hold (S/H) circuit 1006 samples and holds an output signal of the CCD line sensor 1005 for every pixel. Output signals of R, G, and B of the S/H circuit 1006 are converted into digital signals by an A/D converter 1007. The digital signals of the A/D converter 1007 are supplied to a shading correction circuit 1008, by which a sensitivity variation and an output variation among the pixels of the CCD line sensor are corrected. The R, G, and B signals which are supplied from the shading correction circuit 1008 are transmitted through a color correction circuit 1009 and an input masking circuit 1010 and are converted into signals of the complementary colors of cyan (C), magenta (M), and yellow (Y) by a logarithm (LOG) conversion circuit 1012. A minimum value black (Bk) signal of C, M, and Y is extracted by a black extraction circuit 1013. A masking circuit 1014 and an under-color removing (UCR) circuit 1015 execute a well-known color correcting process to the C, M, Y, and Bk signals. A processed output signal of the UCR circuit 1015 is transferred to an FM head driver 1019. A signal supplied from the interface section A is also processed in a manner similar to the above. A signal supplied from the YMC system is transferred to the black extraction circuit 1013 and a processing signal producing circuit 1016 without passing through the LOG conversion circuit 1012. The YMC output signals from the LOG conversion circuit 1012 are supplied to the processing signal producing circuit 1016, by which a signal (Y+M+C)/3 is produced and is sent to a controller 1018 via an edge detection circuit 1017. The controller 1018 controls the FM head driver 1019, which will be explained hereinlater, on the basis of information from the edge detection circuit 1017. The controller 1018 has an ROM in which a program shown in FIG. 5, which will be explained hereinlater, and strobe pattern data shown in FIGS. 4 and 6 have been stored. The controller 1018 manages input signals from the scanner section 1001 to 1005 or the interface section A and adjusts each section in accordance with an edge portion of the original image, thereby finally obtaining an output of a high quality. In the embodiment, although only one controller 1018 has been used, the scanner section, operation panel, head driver, and the like can be also properly managed by a plurality of controllers. A page memory to temporarily store color image data can be also used.

Figure 2:
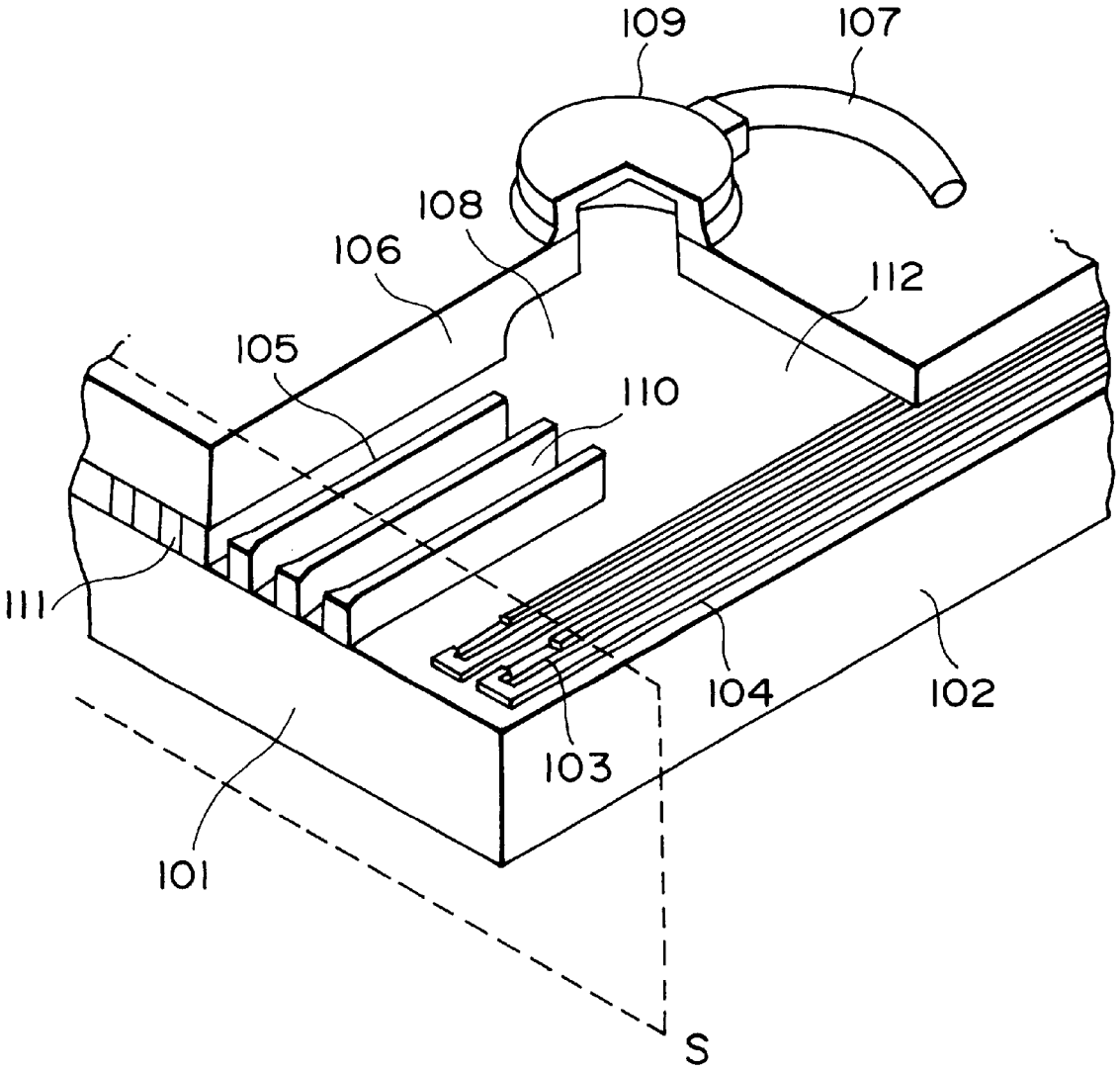
FIG. 2 is a diagram showing an ink jet recording head of the first embodiment.

FIG. 2 is a schematic constructional diagram of the foregoing ink jet recording head section. The head section is constructed by electrothermal converting elements 103, electrodes 104, nozzle walls 105, and a top plate 106 which are formed like a film on a board 102 through semiconductor manufacturing processing steps such as etching, evaporation deposition, sputtering, and the like. A recording liquid 112 is supplied from a liquid tank (not shown) through a liquid supply tube 107 into a common liquid chamber 108 of a recording head 101. In FIG. 2, reference numeral 109 denotes a connector for the liquid supply tube. The liquid 112 supplied into the common liquid chamber 108 is transferred into liquid paths 110 by capillary action and meniscuses are formed at positions near the emission ports, so that the liquid is stably held. By supplying a current to each electrothermal converting element 103, the liquid existing on the surface of the electrothermal converting element is heated and a forming phenomenon occurs. A liquid droplet is emitted from each emission port 111 by a foaming energy of a bubble. By the above construction, the ink jet recording head having an emission port array of a high density of 400 dpi is formed.

Figure 3:
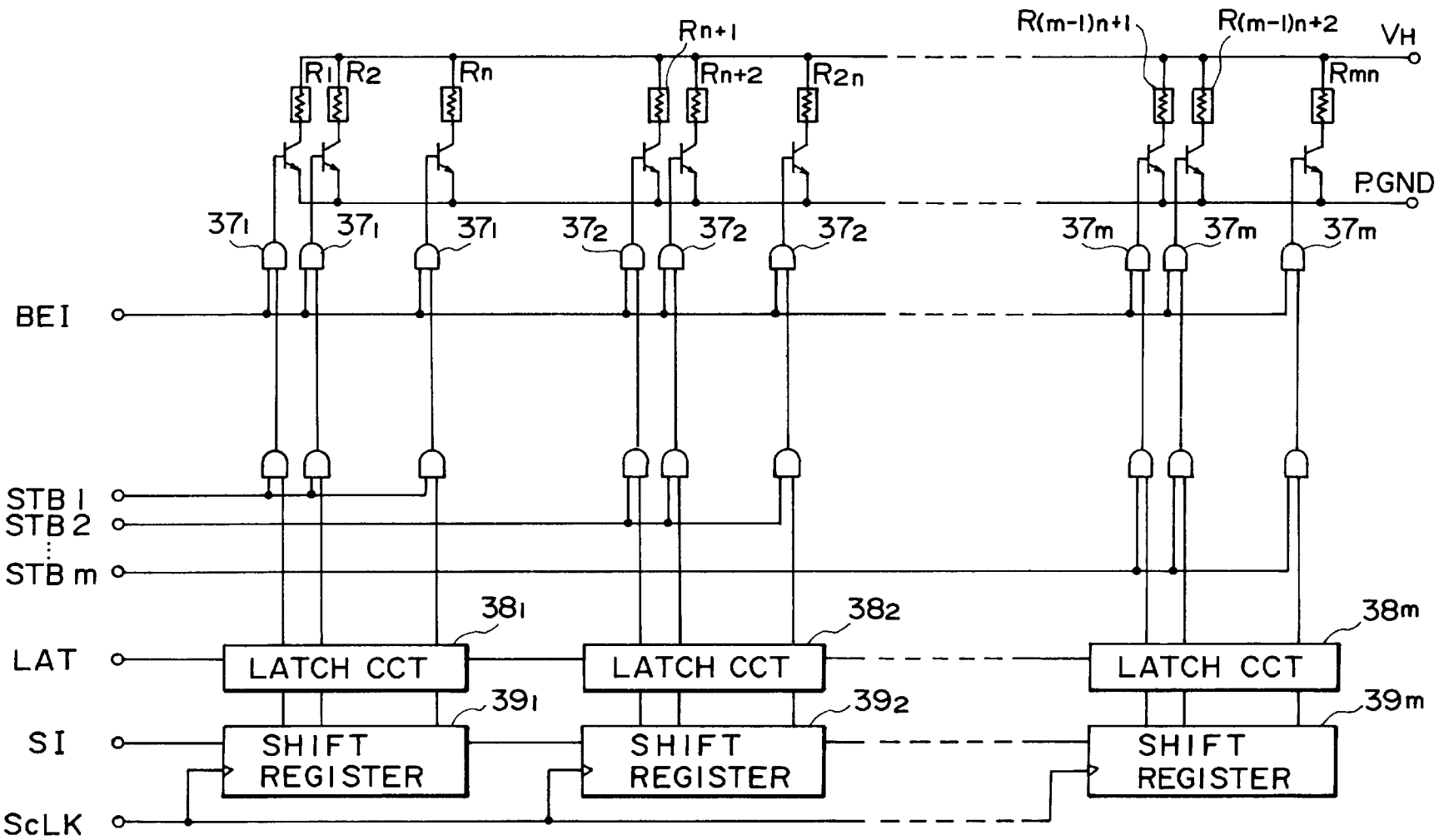
FIG. 3 is a block diagram showing a recording head driver in the first embodiment.

FIG. 3 is a block diagram of a recording head driver showing an embodiment of the invention. In the embodiment, there is shown a driver in which n electrothermal converting elements comprise one block and the electrothermal converting elements of m blocks are driven. Therefore, n electrothermal converting elements correspond to one unit of a driving IC comprising latch circuits, shift registers, and AND gates.

In FIG. 3, $R_1$ to $R_{mn}$ denote electrothermal converting elements. A common electrode $V_H$ to apply a voltage $V_H$ to the electrothermal converting elements $R_1$ to $R_{mn}$ is connected to one end of each of the converting elements. The other ends of the converting elements $R_1$ to $R_{mn}$ are connected to a ground terminal $P_{GND}$.

Reference numerals $\mathbf{39}_1$ to $\mathbf{39}_m$ denote the shift registers each consisting of n bits. Outputs of the shift registers correspond to n electrothermal converting elements of each block, respectively. SI denotes a terminal to input recording data SI. The recording data SI which is serially input is supplied to the shift register $\mathbf{39}_1$ at the first stage on the basis of a recording data transfer clock SCLK and is sequentially shifted, so that (n×m) recording data SI is stored into the registers $\mathbf{39}_1$ to $\mathbf{39}_m$. After the recording data of one line as mentioned above was transferred, the data is latched into the n-bit latch circuit 38 on the basis of an input signal LAT. The electrothermal converting elements $R_1$ to $R_{mn}$ are actuated corresponding to the recording data as mentioned above. The recording data transfer clocks SCLK of only the number which is equal to the number of electrothermal converting elements of one line are input to the shift registers $\mathbf{39}_1$ to $\mathbf{39}_m$.

BEI denotes a terminal to input a fundamental signal BEI. A pulse width of fundamental signal BEI corresponds to a current supplying time according to an electric power which is necessary to divisionally drive the electrothermal converting elements. Such a pulse width corresponds to an energy which is applied to the electrothermal converting element to emit an ink droplet.

Each of driving blocks divided by strobe signals (STB) shown in FIG. 3 is constructed by n (e.g., 128) elements.

Figure 4:
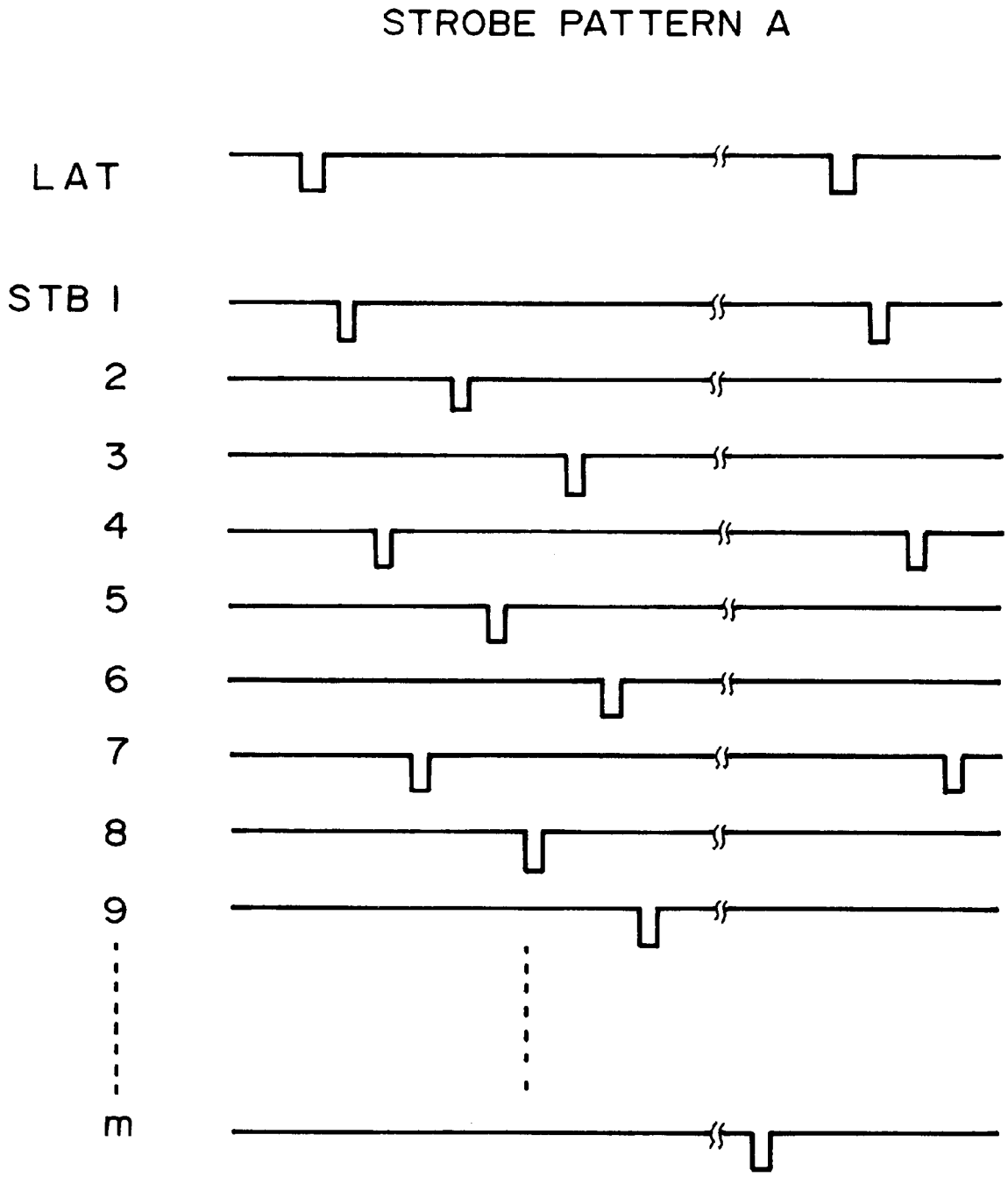
FIG. 4 is a timing chart showing an example of the timing of each section shown in FIG. 3.

The circuit fundamentally operates in a manner such that a recording image signal of one line, that is, 4736 bits is supplied and the recording image signal is latched by a latch signal and, thereafter, the strobe signals $STB_1$ to $STB_m$ (=$STB_{37}$) are sequentially turned on, thereby completing the driving of each driving block. FIG. 4 shows timings for the above series of operations which are managed by the controller 1018. A time difference between the strobe signals STB is set to 10 $\mu$sec.

In the half tone image of a duty ratio of 50% obtained by driving as mentioned above, a concentration variation of a period of 128 dots occurred in the case of the driving method of the conventional apparatus. However, according to the embodiment of the invention, a uniform image could be obtained.

Figure 5:
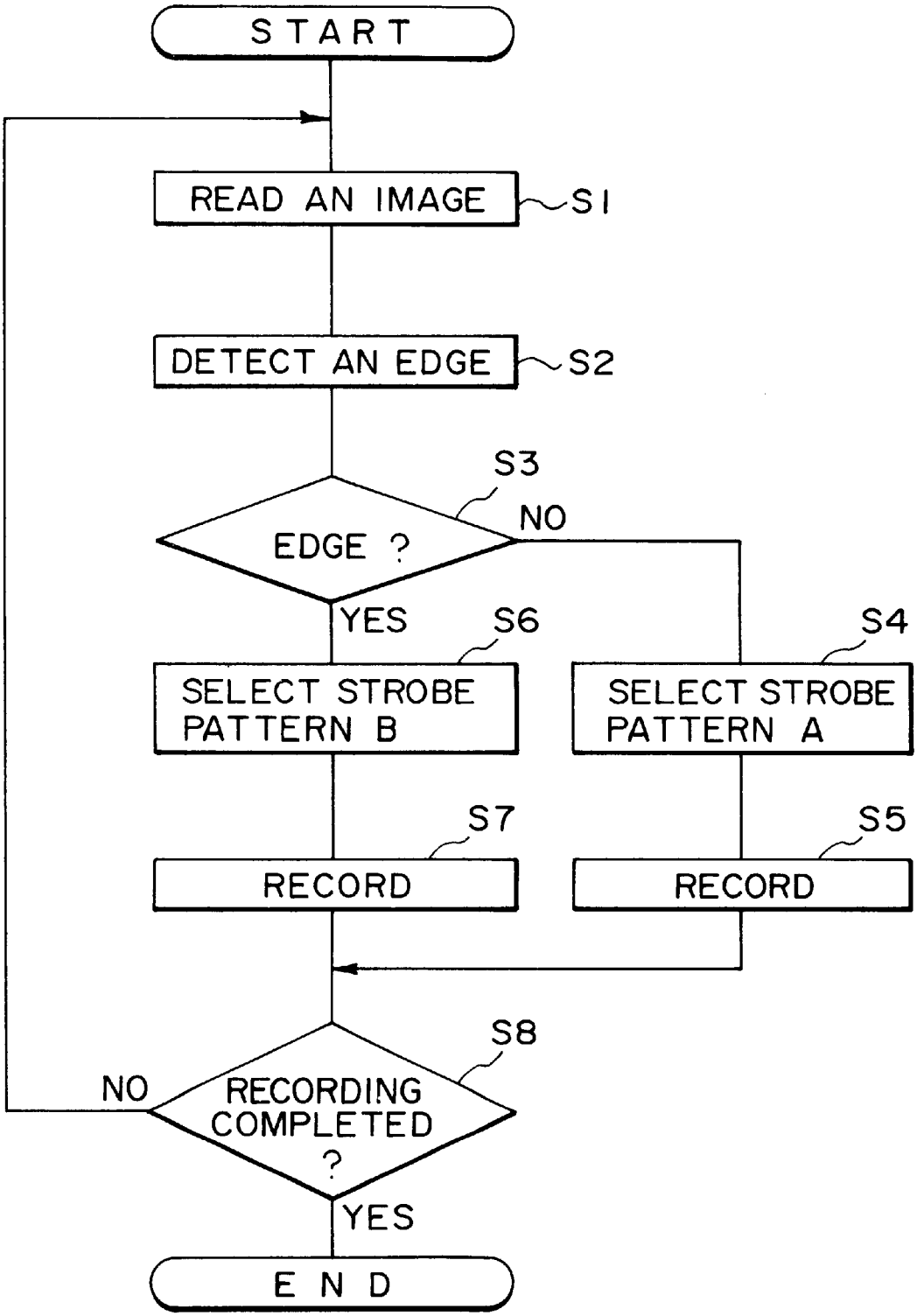
FIG. 5 is a flowchart showing an example of the operation of a controller.
Figure 6:
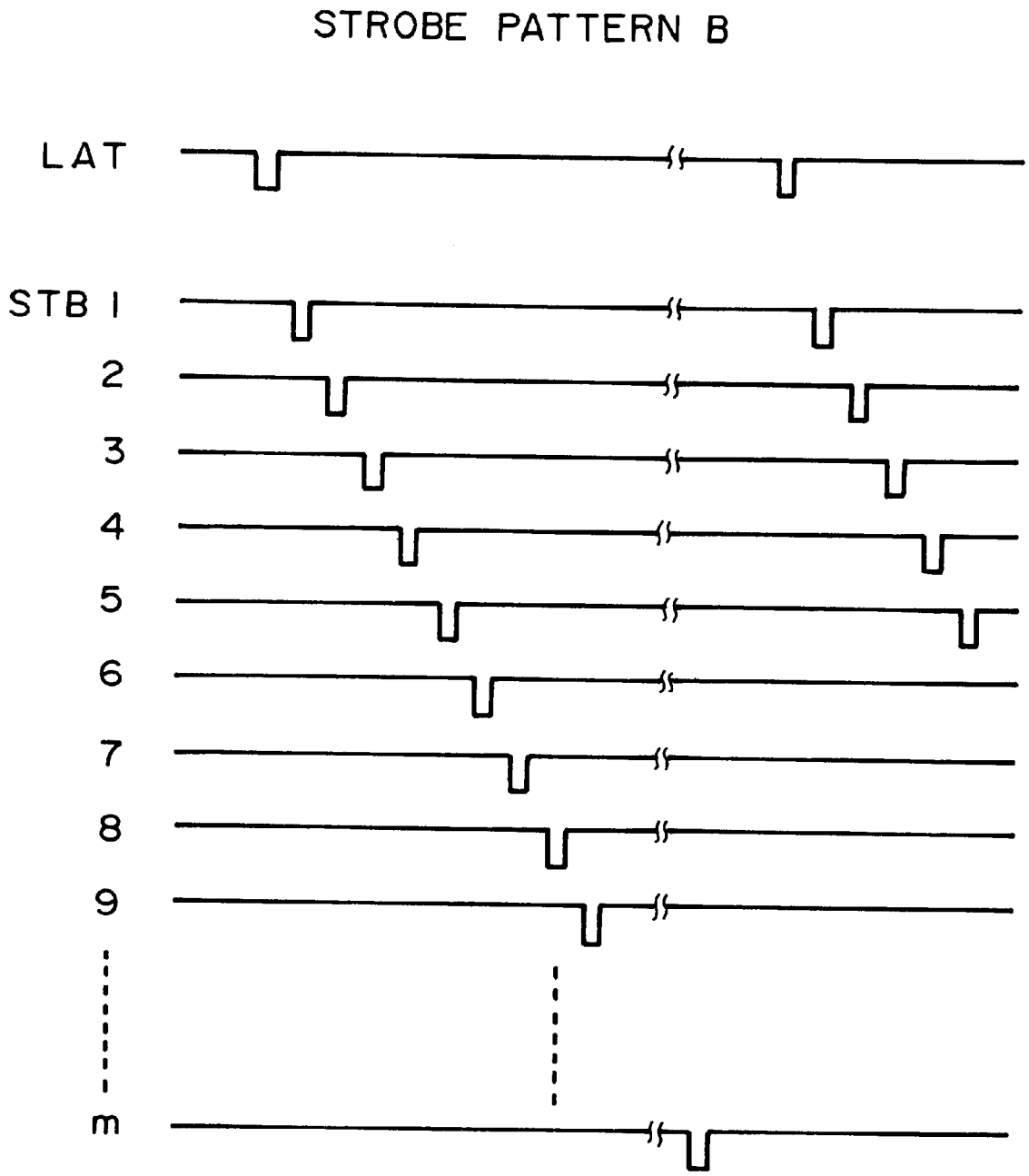
FIG. 6 is a timing chart showing another example of the timing of each section shown in FIG. 3.

FIG. 5 is a flowchart showing processes which are executed by the controller 1018.

In step S1, the scanner section (1001 to 1005 in FIG. 11) or the interface section A is controlled and an original image is read (input). In step S2, an edge of the original image is detected by making the edge detection circuit 1017 operative. In step S3, the presence or absence of an edge component is discriminated. If it is determined that no edge exists as a result of the discrimination, the image is regarded to be a half tone image and step S4 follows. In step S4, a pattern of the strobe signal shown in FIG. 4, namely, a strobe pattern A is selected. In step S5, the FM head driver 1019 is actuated and the recording is executed. In step S8, a check is made to see if the recording has been completed or not. If YES, the recording is finished. On the contrary, if the recording is not finished yet, the processing routine is returned to step S1.

On the other hand, if it is determined in step S3 that the edge component exists, step S6 follows. In step S6, a pattern of the strobe signal shown in FIG. 6, that is, a strobe pattern B is selected. This means that the linearity of the line is selected for the edge portion of a character line or the like. In step S7, the recording is performed and step S8 then follows.

Thus, a concentration variation of the period of 128 dots is hardly conspicuous in the edge portion. A well-known Laplacian masking method or the like is used as a method of extracting an edge component on a unit basis of a few mm.

In the embodiment, 37 strobe signals have been independently prepared. However, it is also possible to construct in a manner such that the electrothermal converting elements are divided into 54 blocks each comprising 64 emission ports and the first and 38th blocks, the second and 39th blocks, . . . , and the 37th and 54th blocks are respectively connected as a common strobe signal, and the driving order is set to 1, 4, 7, . . . , 37, 2, 5, 8, . . . , 35, 3, 6, 9, . . . , 36.

Second embodiment

The second embodiment relates to a color image recording apparatus in which an extracting method of an edge component is changed for every color.

An image pattern in which a concentration variation of a period of 128 dots is conspicuous differs depending on the color. For instance, in the case of a conspicuous magenta image, a concentration variation can be seen even for a sparse half tone having a duty ratio of about 10%. However, in the case of an inconspicuous yellow image, a concentration variation is inconspicuous for a sparse half tone having a duty ratio of about 10% and a concentration variation can be seen for a half tone having a duty ratio of 50% or more.

In consideration of such a characteristic difference, for instance, for magenta, the strobe pattern A is selected in the cases other than the case where an isolated line was detected; while for yellow, the strobe pattern B is selected in the cases other than the complete half tone.

Third embodiment

Figure 7:
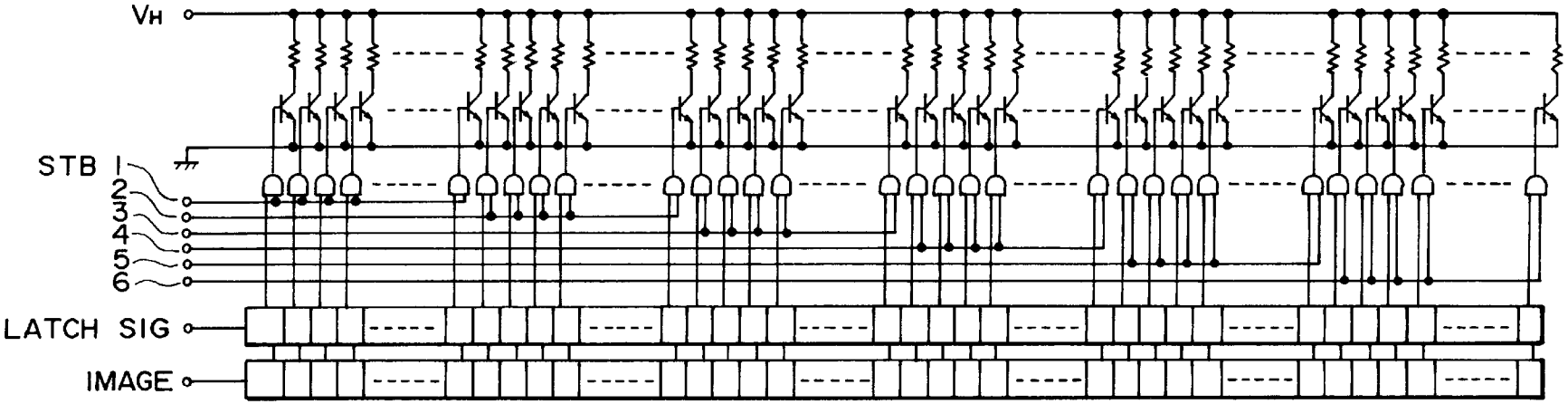
FIG. 7 is a block diagram showing a recording head driver in the third embodiment.

FIG. 7 shows a block diagram of the head used in the third embodiment.

The third embodiment relates to an example in which driving blocks which are not neighboring are sequentially driven.

In the embodiment, there is used a bubble jet type head in which a current is supplied to a heat generating resistor element and a bubble is generated in an ink and is emitted from a nozzle port. Each of the resistor elements shown in FIG. 7 corresponds to an emission port. The head used in the embodiment is constructed by arranging such 768 resistor elements at a density of 400 dpi. Each of driving blocks divided by the strobe signals (STB) shown in FIG. 7 is constructed by 128 elements. The circuit fundamentally operates in a manner such that a recording image signal of one line, that is, 768 bits is supplied and the recording image signal is latched by a latch signal and, thereafter, the strobe signals $STB_1$ to $STB_6$ are sequentially turned on, thereby completing the driving of each driving block.

Figure 8A:
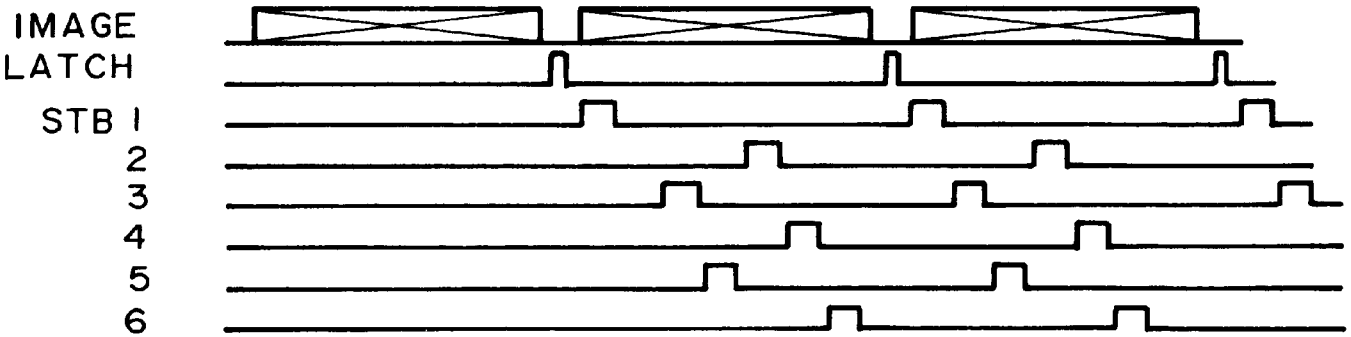
FIGS. 8A and 8B are timing charts showing an example of the timing of each section shown in FIG. 7.
Figure 8B:
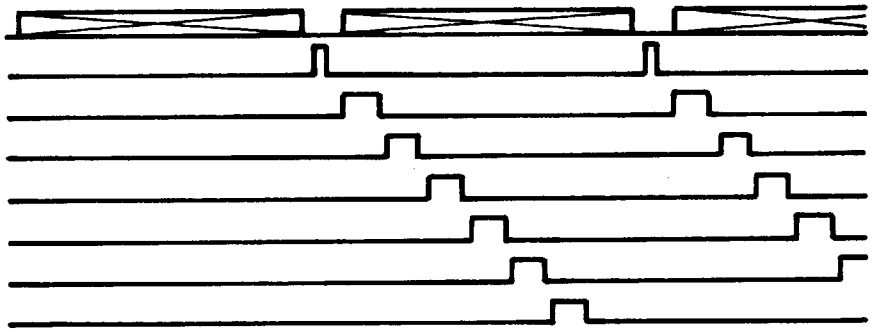
Figure 9:
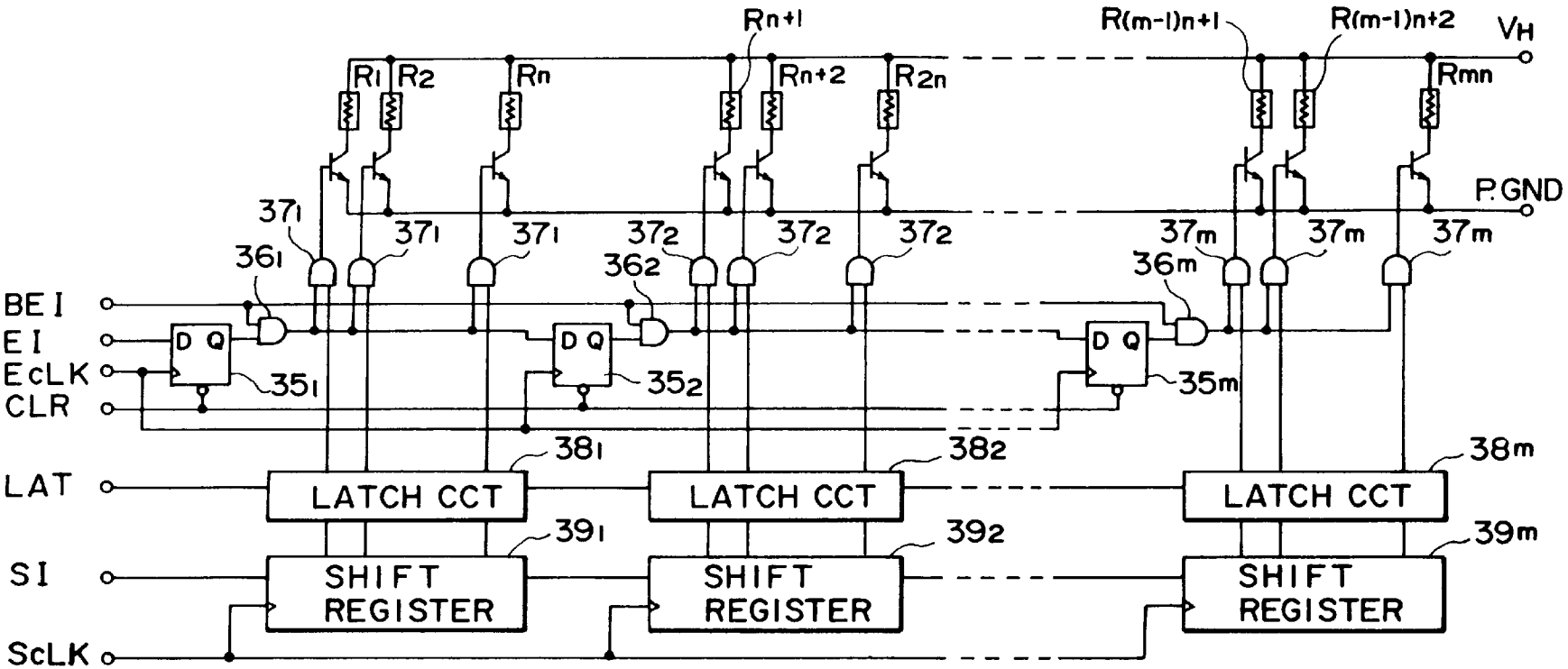
FIG. 9 PRIOR ART
FIG. 9 is a block diagram showing a recording head driver in a conventional example.
Figure 10:
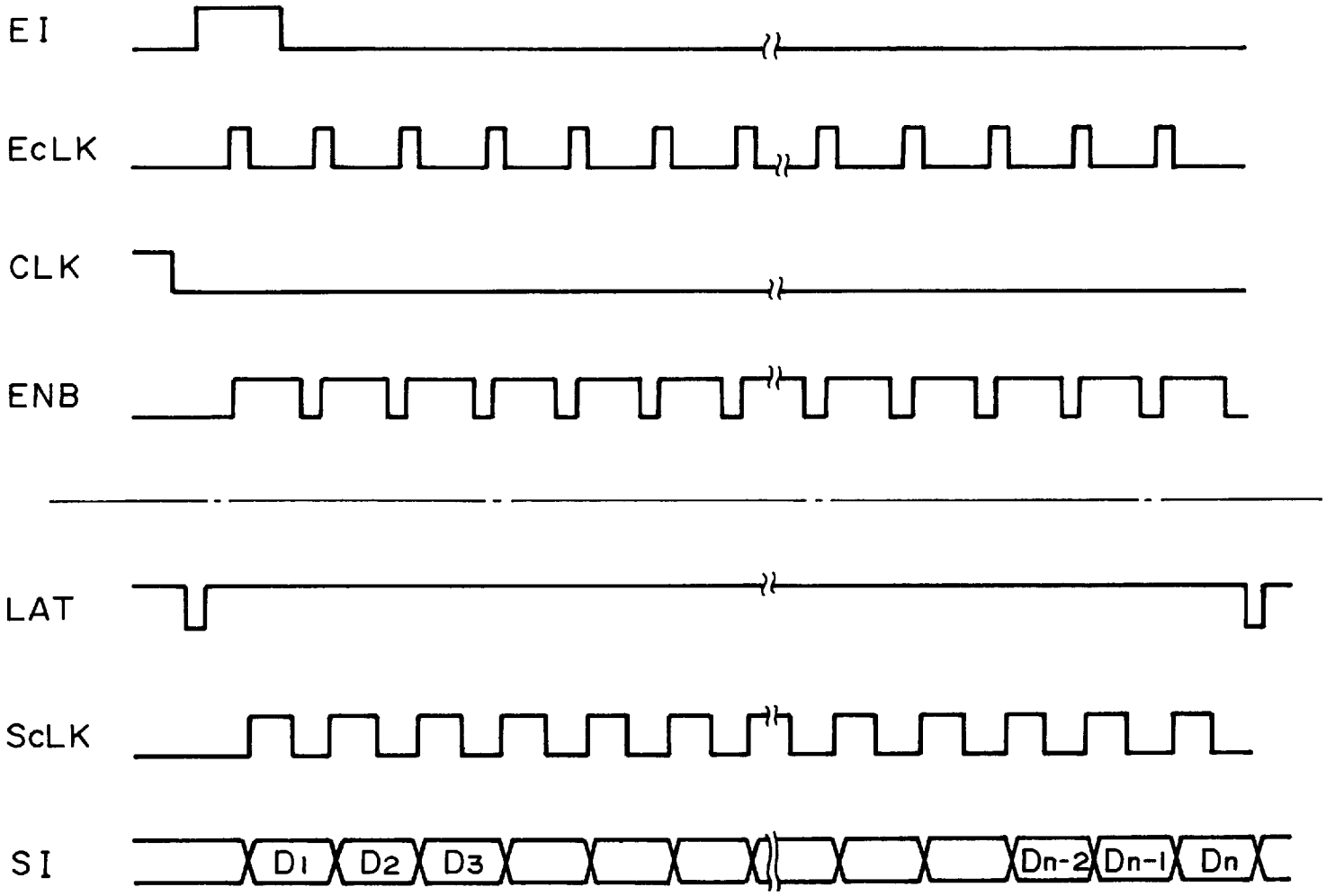
FIG. 10 is a timing chart showing an example of the timing of each section shown in FIG. 9.

FIG. 8 shows timings of the above series of operations. FIG. 8A shows the timings in the embodiment. FIG. 8B shows the timings in the conventional apparatus for comparison.

An ON time of the strobe signal STB is set to 7 μsec and a time difference between the strobe signals STB is set to 10 μsec. For the image obtained by driving as mentioned above, a concentration variation of a period of 128 dots occurred in the conventional apparatus. However, a uniform image could be obtained in the embodiment.

In the case of the head which is constructed by arranging 4736 nozzles in a line at a density of 400 dpi, the nozzles are divided into 37 driving blocks each comprising 128 emission ports. Assuming that the 37 blocks are set to the first block, . . . , and the 37th block from the leftmost block, a uniform image was obtained by driving the blocks in accordance with the order of 1, 4, 7, 2, 5, 8, 3, 6, . . . , 33, 36, 34, 37, and 35. In the case of the head in which the 1024 nozzles arranged are divided into 16 blocks every 64 nozzles, the blocks of Nos. 1 and 9, the blocks of Nos. 2 and 10, the blocks of Nos. 3 and 11, . . . , and the blocks of Nos. 8 and 16 are connected as common strobe signals. Therefore, the number of terminals of the strobe signals is set to eight. A uniform image was obtained by driving the blocks in accordance with the order of 1, 4, 7, 2, 5, 8, 3, and 6. A pulse width is set to 10 μsec and an interval between the blocks is set to 12 μsec.

By driving the adjacent blocks, a pressure wave is propagated to the ink and a vibration of the meniscus is generated. If an operation is executed during such a time interval, the emission will be made unstable. In the embodiment, the portions without such an influence are sequentially recorded, so that a uniform recording image can be obtained. The above-described control can be also instructed from the operation panel 1020 shown in FIG. 11.

Other Embodiments

In particular, the invention provides excellent effects in the recording head and recording apparatus of the bubble jet method among the ink jet recording methods. This is because a high density and a high definition of the recording can be accomplished according to such a method.

As typical construction and principle, for instance, it is preferable to use the fundamental principles disclosed in the specifications of U.S. Pat. Nos. 4,723,129 and 4,740,796. The above method can be also applied to both of what are called on-demand type and continuous type. Particularly, in the case of the on-demand type, the above method is effective because at least one driving signal which gives a sudden temperature increase which corresponds to recording information and exceeds nucleate boiling is applied to the electrothermal converting element arranged in correspondence to the sheet or liquid path on which the liquid (ink) is held, thereby generating a heat energy in the electrothermal converting element and causing a film boiling on the heat acting surface of the recording head, so that air bubbles can be formed in the liquid (ink) so as to correspond to the driving signals in a one-to-one corresponding manner. The liquid (ink) is emitted through an emitting opening by the growth and contraction of the bubble, thereby forming at least one droplet. By applying the driving signal as a pulse-shaped signal, the growth and contraction of the bubble are immediately properly executed. Therefore, the emission of the liquid (ink) having an excellent response speed can be accomplished in particular. Thus, such a method is further preferable. As a pulse-shaped driving signal, it is proper to use a driving signal as disclosed in the specification of U.S. Pat. Nos. 4,463,359 or 4,345,262.

Further excellent recording can be performed by using the conditions disclosed in the specification of U.S. Pat. No. 4,313,124 of the invention regarding a temperature increase ratio at the heat acting surface.

A construction of the recording head is not limited to the construction of a combination of the emission ports, liquid paths, and electrothermal converting elements (linear liquid paths or orthogonal liquid paths) as disclosed in each of the above specifications. The invention also incorporates constructions using the specifications of U.S. Pat. Nos. 4,558,333 and 4,459,600 each of which discloses a construction in which a thermal acting section is arranged in a curved region. In addition, the invention is also effective to a construction based on Japanese Laid-Open Patent Application No. 59-123670 disclosing a construction in which a slit which is commonly used for a plurality of electrothermal converting elements is used as an emitting port of the electrothermal converting elements or Japanese Laid-Open Patent Application No. 59-138461 disclosing a construction in which an opening to absorb a pressure wave of a heat energy is made corresponding to an emitting portion. This is because the recording can be certainly efficiently performed irrespective of the shape of the recording head.

Further, the invention can be also effectively applied to a recording head of the full-line type having a length corresponding to the maximum width of a recording medium on which the recording apparatus can record. As such a recording head, it is possible to use a construction in which such a length is satisfied by a combination of a plurality of recording heads or a construction as a single recording head which is integrally formed. In addition, even in the case of the serial type as mentioned above, the invention can be also effectively applied to a recording head of the exchangeable chip type in which by installing the head into the apparatus main body, the head can be electrically connected to the apparatus main body and the ink can be supplied from the apparatus main body or a recording head of the cartridge type in which necessary components such as ink tank, electrothermal converting elements, and the like are integrally assembled in the recording head itself.

It is preferable that recovery means, spare auxiliary means, and the like for the recording head which are provided as component elements of the recording apparatus are added to the invention because the effect of the invention can be further stabilized. Practically speaking, to stably record, it is also effective to use capping means for the recording head, cleaning means, pressurizing or absorbing means, and electrothermal converting elements or heating elements different therefrom or spare heating means or a combination of those components, or to execute a spare emitting mode for performing a purging emission different from the recording.

With respect to the kind and number of recording heads which are installed, only one head can be provided in correspondence to an ink of a single color or a plurality of heads can be also provided in correspondence to a plurality of inks having different recording colors or concentrations.

Further, the ink jet recording apparatus of the invention is not limited to a construction in which it is used as an image output terminal of a data processing apparatus such as a computer or the like. The invention can be used in a copying apparatus which is combined with a reader or the like or a facsimile apparatus having transmitting and receiving functions.

As described above, according to the invention, since the driving order of the driving blocks is changed in accordance with the result of detection of an edge, there is an effect such that a uniform image without an unevenness can be obtained.

Further, when the driving blocks which are not neighboring are sequentially driven, there is an effect such that a uniform image without an unevenness can be obtained.

What is claimed is:

1. A recording apparatus comprising:

an ink jet recording head in which a plurality of groups of emission openings through which an ink can be elected are arranged, each said group including a plurality of continuously arranged said emission openings;

detecting means for detecting if a pattern of input information has an edge component; and control means for controlling said ink jet recording head such that a driving order of the groups of emission openings is sequentially and successively changed in an event that said detecting means detects said edge component, and when said detecting means does not detect said edge component, said groups which are not neighboring are sequentially driven.

2. An apparatus according to claim 1, wherein said recording head causes a volume change in ink due to an action of heat energy, thereby emitting ink from said emission openings.

3. An apparatus according to claim 1, wherein said emission openings in each group are simultaneously driven.

4. An apparatus according to claim 2, wherein said emission openings in each group are simultaneously driven.

5. An apparatus according to claim 1, wherein said apparatus produces a color image.

6. An apparatus according to claim 2, wherein said apparatus produces a color image.

7. An apparatus according to claim 3, wherein said apparatus produces a color image.

8. An apparatus according to claim 4, wherein said apparatus produces a color image.

9. An apparatus according to claim 1, further comprising input means comprising an interface for receiving the information from an external source.

10. An apparatus according to claim 2, further comprising input means comprising an interface for receiving information from an external source.

11. An apparatus according to claim 3, further comprising input means comprising an interface for receiving information from an external source.

12. An apparatus according to claim 4, further comprising input means comprising an interface for receiving information from an external source.

13. An apparatus according to claim 5, further comprising input means comprising an interface for receiving information from an external source.

14. An apparatus according to claim 6, further comprising input means comprising an interface for receiving information from an external source.

15. An apparatus according to claim 7, further comprising input means comprising an interface for receiving information from an external source.

16. An apparatus according to claim 8, further comprising input means comprising an interface for receiving information from an external source.

17. An apparatus according to claim 1, further comprising input means for inputting the input information representing the pattern comprising scanner means for reading a document.

18. An apparatus according to claim 2, further comprising input means for inputting the input information representing the pattern comprising scanner means for reading a document.

19. An apparatus according to claim 3, further comprising input means for inputting the input information representing the pattern comprising scanner means for reading a document.

20. An apparatus according to claim 4, further comprising input means for inputting the input information representing the pattern comprising scanner means for reading a document.

21. An apparatus according to claim 5, further comprising input means for inputting the input information representing the pattern comprising scanner means for reading a document.

22. An apparatus according to claim 6, further comprising input means for inputting the input information representing the pattern comprising scanner means for reading a document.

23. An apparatus according to claim 7, further comprising input means for inputting the input information representing the pattern comprising scanner means for reading a document.

24. An apparatus according to claim 8, further comprising input means for inputting the input information representing the pattern comprising scanner means for reading a document.

25. A recording apparatus according to claim 9, further comprising scanner means for reading a document and switch means for switching between recording of information from said scanner means and recording of the information from the external source.

26. An apparatus according to claim 9, wherein said input means further comprises scanner means for reading a document.

27. A recording apparatus according to claim 1, wherein said input information comprises image data.

28. A recording apparatus according to claim 1, further comprising a transport means for transporting a recording medium onto which the pattern to be output is formed.

29. A recording apparatus comprising:

an ink jet recording head in which a plurality of groups of emission openings through which an ink can be ejected are arranged, each said group including a plurality of continuously arranged said emission openings;

input means for inputting information representing a pattern to be output;

driving means for driving said groups of emission openings in a driving order; and control means for controlling said driving order of said groups of emission openings depending on whether the pattern to be output has an edge component, so as to maintain linearity of a line.

30. An apparatus according to claim 29, wherein said emission openings in each group are simultaneously driven.

31. An apparatus according to claim 29, wherein said apparatus produces a color image.

32. An apparatus according to claim 30, wherein said apparatus produces a color image.

33. An apparatus according to claim 30, wherein said input means comprises an interface for receiving information from an external source.

34. An apparatus according to claim 31, wherein said input means comprises an interface for receiving information from an external source.

35. An apparatus according to claim 32, wherein said input means comprises an interface for receiving information from an external source.

36. An apparatus according to claim 30, wherein said input means comprises scanner means for reading a document.

37. An apparatus according to claim 31, wherein said input means comprises scanner means for reading a document.

38. An apparatus according to claim 32, wherein said input means comprises scanner means for reading a document.

39. A recording apparatus according to claim 29, wherein said input means comprises an interface for receiving the information from an external source.

40. A recording apparatus according to claim 39, further comprising scanner means for reading a document and switch means for switching between recording of information from said scanner means and recording of the information from the external source.

41. An apparatus according to claim 39, wherein said input means further comprises scanner means for reading a document.

42. An apparatus according to claim 1, wherein said control means controls the driving order according to whether the pattern to be output comprises a half tone pattern having no linearity.

43. an apparatus according to claim 29, wherein said control means controls the driving order so as not to change when the pattern to be output comprises a straight line.

44. A recording apparatus according to claim 29, wherein said input information comprises image data.

45. A recording apparatus according to claim 29, further comprising a transport means for transporting a recording medium onto which the pattern to be output is formed.

46. A recording apparatus comprising:

an ink jet recording head in which a plurality of groups of emission openings through which an ink can be ejected are arranged, each said group including a plurality of continuously arranged said emission openings;

input means for inputting information representing a pattern to be output;

driving means for driving said groups of emission openings in a driving order; and control means for controlling said driving order of said groups of emission openings depending on what type of color the pattern to be output has, so as to eliminate variations in recording density.

47. A recording apparatus according to claim 46, further comprising detecting means for detecting whether the pattern has an edge component, wherein when the color is dark and if said detecting means detects no such edge component, said control means controls said driving means to sequentially and successively change said driving order of said groups of emission openings, and when the color is light and unless the pattern consists of a complete half tone, said control means controls said driving means to sequentially drive said groups which are not neighboring.

48. A recording apparatus according to claim 46, wherein said input means comprises a scanner.

49. A recording apparatus according to claim 46, wherein said input means comprises an interface.

50. A recording apparatus according to claim 46, further comprising a transport means for transporting a recording medium onto which the pattern to be output is formed.

* * * * *

UNITED STATES PATENT AND TRADEMARK OFFICE

CERTIFICATE OF CORRECTION

PATENT NO. : 5,909,229

DATED : June 1, 1999

INVENTOR(S) : HARUHIKO MORIGUCHI ET AL.

It is certified that error appears in the above-identified patent and that said Letters Patent is hereby corrected as shown below:

COLUMN 8

Line 41, "the" should be deleted.

COLUMN 10

Line 4, "elected" should read --ejected--.

COLUMN 12 line 17, "claim 1," should read --claim 29,--.

Signed and Sealed this

Ninth Day of January, 2001

*Attest:*

Q. TODD DICKINSON

*Attesting Officer*

*Commissioner of Patents and Trademarks*